US006354801B1

(12) United States Patent
Gajewski

(10) Patent No.: US 6,354,801 B1
(45) Date of Patent: Mar. 12, 2002

(54) CEILING FAN HOUSING ASSEMBLY

(75) Inventor: Mark Gajewski, Culver, CA (US)

(73) Assignee: Minka Lighting, Inc., Corona, CA (US)

( * ) Notice: Subject to any disclaimer, the term of this patent is extended or adjusted under 35 U.S.C. 154(b) by 0 days.

(21) Appl. No.: 09/476,637

(22) Filed: Dec. 31, 1999

Related U.S. Application Data

(62) Division of application No. 29/104,917, filed on May 10, 1999.

(51) Int. Cl.[7] ..... F04D 29/00
(52) U.S. Cl. ..... 416/5; 416/247 R; 415/121.2
(58) Field of Search ..... 415/121.2, 213.1, 415/214.1; 416/5, 210 R, 247 R, 244 R

(56) References Cited

U.S. PATENT DOCUMENTS

| | | | | | |
|---|---|---|---|---|---|
| D133,120 | S | | 7/1942 | Spear | |
| 3,261,544 | A | * | 7/1966 | Guichard | 416/247 R |
| D262,736 | S | | 1/1982 | Wooden | D23/165 |
| 4,518,314 | A | * | 5/1985 | Schultz | 416/93 R |
| 4,657,485 | A | | 4/1987 | Hartwig | 416/247 |
| 4,884,947 | A | * | 12/1989 | Rezek | 416/5 |
| 5,151,011 | A | * | 9/1992 | Rezek | 416/5 |
| 5,222,864 | A | * | 6/1993 | Pearce | 416/5 |
| 5,601,412 | A | * | 2/1997 | Vice | 416/247 R |
| 5,645,403 | A | | 7/1997 | Bogage | 416/235 |
| 5,658,129 | A | * | 8/1997 | Pearce | 416/5 |
| 5,899,663 | A | * | 5/1999 | Feder et al. | 176/5 |

OTHER PUBLICATIONS

Related Application Serial No, 29/104,917 filed May 10, 1999, Inventor Mark Gajewski, now allowed.
Related Application Serial No. 29/104,916 filed May 10, 1999, Inventor Mark Gajewski, now allowed.
Related Application Serial No. 29/104,632 filed May 10, 1999, Inventor Mark Gajewski, pending.

* cited by examiner

*Primary Examiner*—Edward K. Look
*Assistant Examiner*—Ninh Nguyen
(74) *Attorney, Agent, or Firm*—Jenkens & Gilchrist, P.C.

(57) ABSTRACT

A ceiling fan having a down rod assembly, a motor, fan blades, an upper body, a hub assembly, and a cage. The cage provides an open enclosure for protecting the motor. The hub includes a hub canister and a hub cover. A lighting kit includes a lighting fixture within the hub canister and a lighting cover that is interchangeable with the hub cover.

17 Claims, 4 Drawing Sheets

CEILING FAN HOUSING ASSEMBLY

RELATED APPLICATION

This is a division of design application Ser. No. 29/104,917, filed May 10, 1999, which is hereby incorporated in its entirety herein by specific reference thereto.

The present application is related to U.S. application Ser. No. 29/104,632, filed on May 10, 1999, currently pending; and U.S. application Ser. No. 29/104,916 filed on May 10, 1999, currently pending.

BACKGROUND

The present invention relates to ceiling fans.

A typical ceiling fan will include a down rod assembly suspended from the ceiling, a motor having a motor shaft connected to a lower portion of the down rod assembly and a motor body which rotates about the motor shaft, a motor housing secured to either the motor shaft or the down rod assembly which is stationary and surrounds the motor, blade mounting arms which are connect to the motor body and extend out of an opening of the motor housing or below the motor housing, and a hub attached to the motor shaft below the fan blades and fan blade arms.

Because the motor housing of a typical ceiling fan encloses the motor, the motor housing must have various openings to allow the escape of heat from the motor. However, the openings in the motor housing complicate the design of the motor housing and may limit the escape of heat from the motor because of the limited availability of the apertures in the motor housing. Therefore, there is a need for a motor housing that will provide the motor with better heat transfer than a typical motor housing.

Many ceiling fans include lighting fixtures which are incorporated into the hub. However, end users may want the versatility of changing between the option of not having a lighting fixture, or the option of having a lighting fixture. Therefore, there is a need for a ceiling fan with the ability to quickly change between the option of having a lighting fixture, and the option of not having a lighting fixture.

SUMMARY

In one embodiment, the present invention comprises a ceiling fan having a motor connected to a plurality of fan blades, a cage surrounding the motor with a fan blade opening, wherein the fan blades extend outwardly through the fan blade opening and the fan blade opening provides clearance for the fan blades to rotate without contacting the cage. In a further embodiment, the cage is a wire cage.

In another embodiment, the present invention comprises a ceiling fan having a motor with a motor shaft, a hub canister containing a lighting fixture, and a detachable hub cover and a detachable light cover, wherein the detachable hub cover and light cover are interchangeable covers for the hub canister. In a further embodiment, the invention further includes hub light electrical leads with hub light electrical connectors, and the light fixture further includes fixture electrical leads with fixture electrical connectors that mate with the hub light electrical connectors. In another further embodiment, the hub canister further includes hub protrusions and the hub cover and the lighting cover further include channels to receive the hub protrusions, thereby securing the respective hub cover or light cover to the hub canister.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
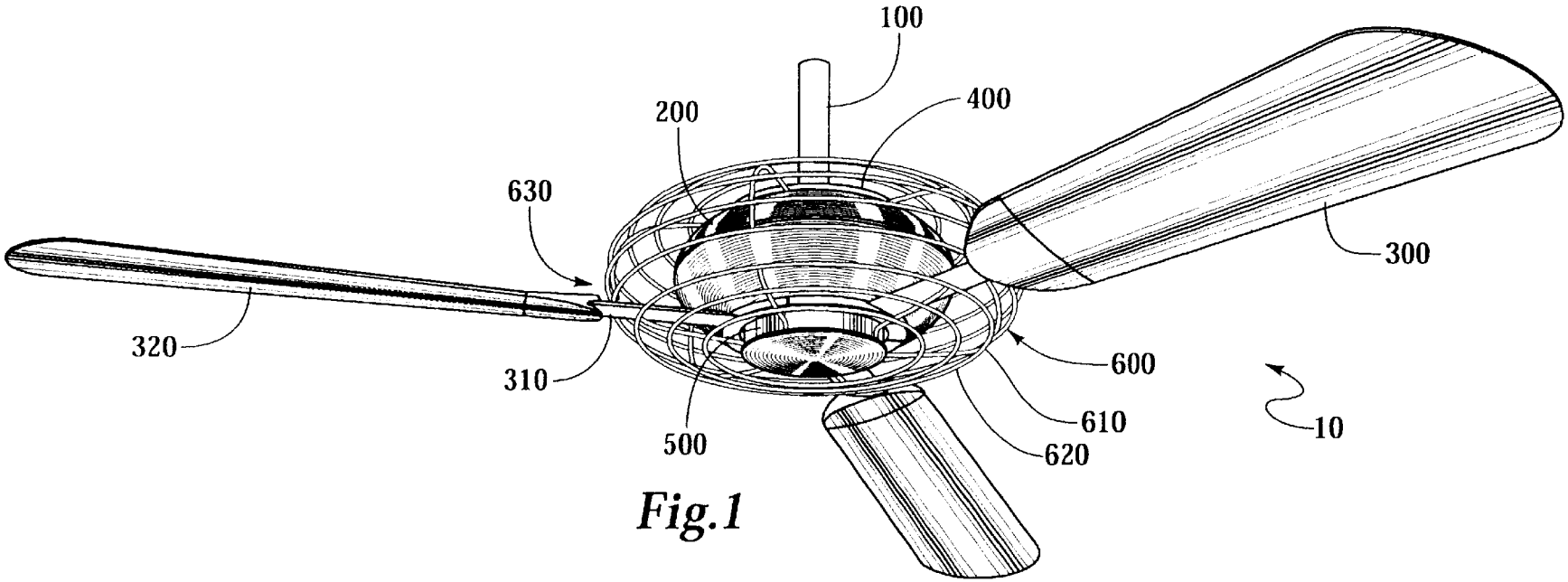
FIG. 1 shows a perspective view of one embodiment of the present invention, illustrated as a ceiling fan.
Figure 2:
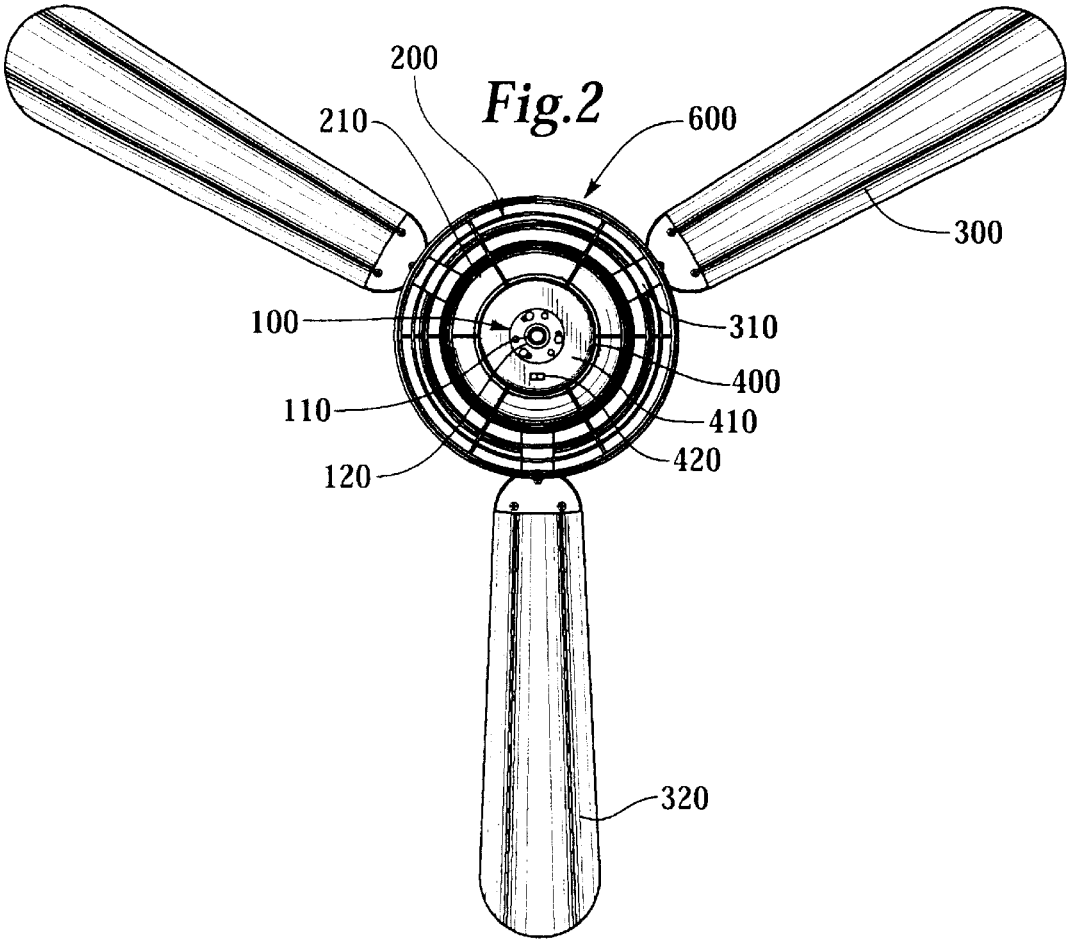
FIG. 2 shows a top plan view of the ceiling fan from FIG. 1.
Figure 3:
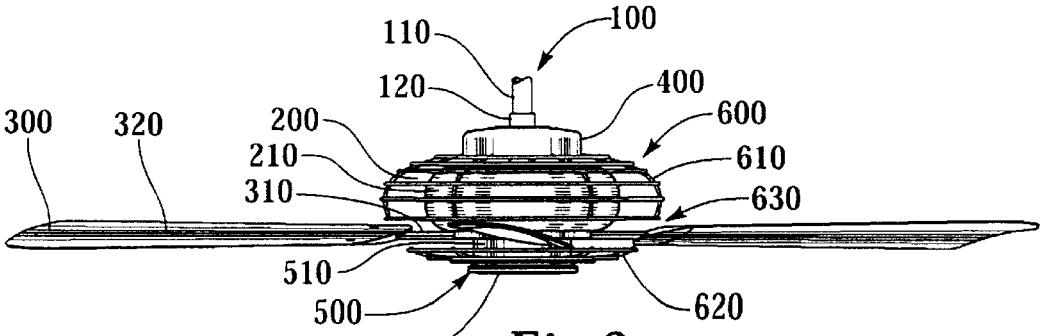
FIG. 3 shows a side elevational view of the ceiling fan from FIG. 1.
Figure 4:
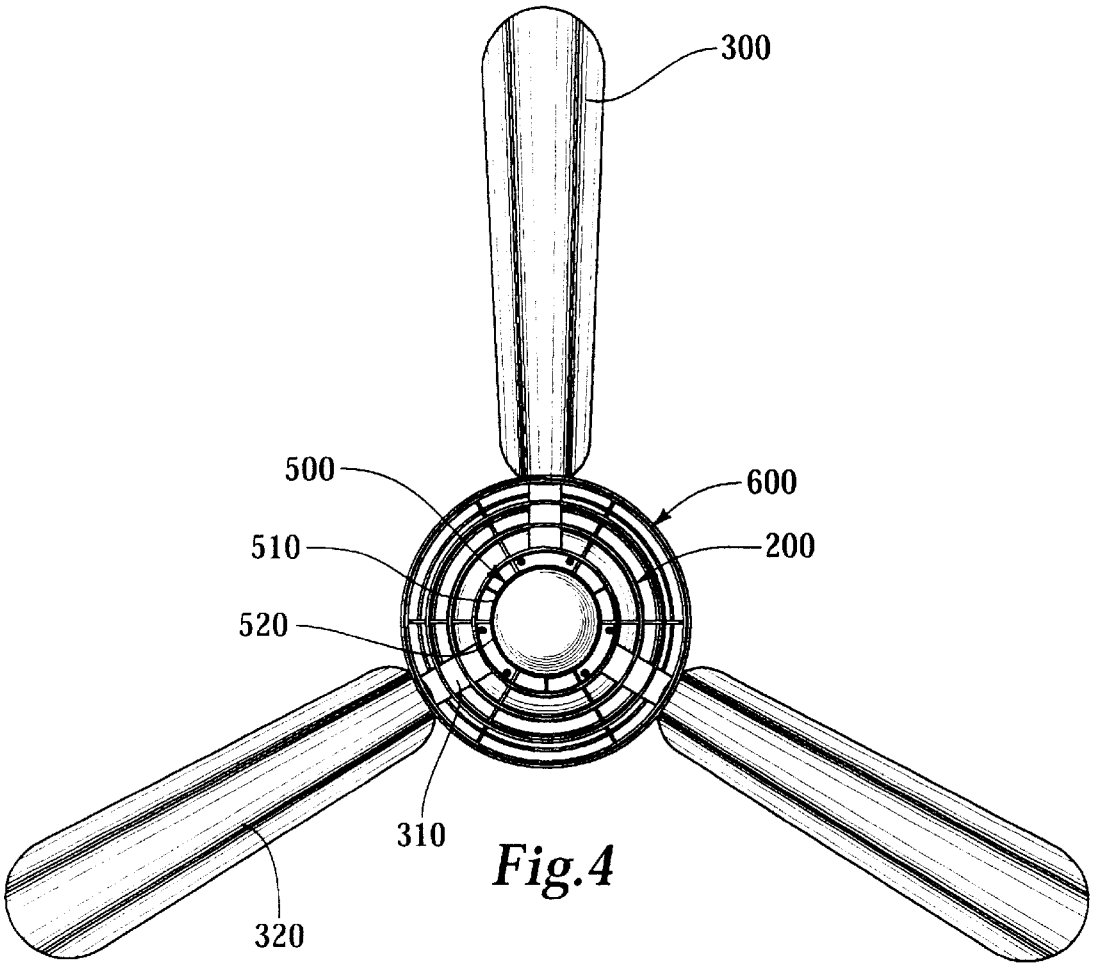
FIG. 4 shows a bottom plan view of the ceiling fan from FIG. 1.
Figure 5:
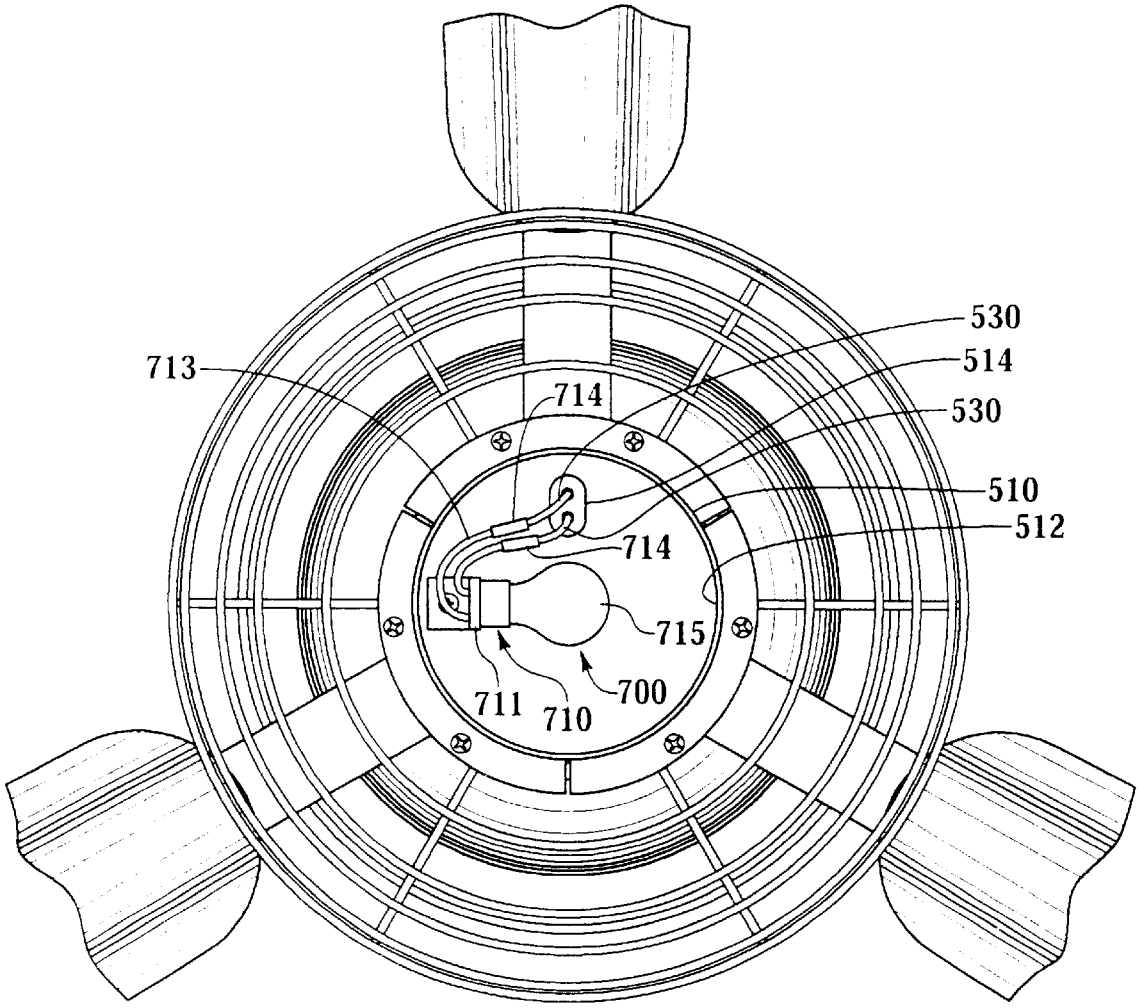
FIG. 5 shows an enlarged partial bottom plan view of the ceiling fan from FIG. 1, with a hub cover removed to illustrate a portion of a lighting kit; and, FIG. 6 shows a side elevational view of the ceiling fan from FIG. 1, illustrating the alternate embodiments with a hub cover or a lighting cover.
Figure 6:
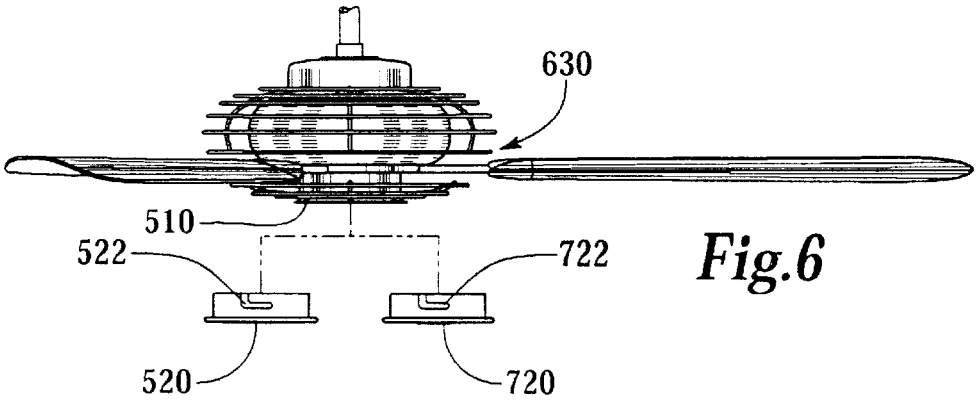

Referring now to the figures, there is shown an embodiment of the present invention illustrated in the ceiling fan 10. The ceiling fan 10 generally includes a down rod assembly 100, a motor 200, fan blades 300, an upper body 400, a hub assembly 500, and a cage 600.

The down rod assembly 100 includes a down rod 110 secured at one end to the location that the ceiling fan 10 depends from, and secured at a second end to a down rod mounting flange 120. The down rod mounting flange 120 is secured to the shaft (not shown) of the motor 200. Electrical wires for powering and controlling the ceiling fan 10 pass through the down rod 110 to the motor 200.

The upper body 400 is secured to the down rod mounting flange 120. A direction switch 410 is disposed on the upper body 400. The electrical powering and control of the ceiling fan 10 is well known in the art; therefore, in the interest of brevity, are not explained in detail here.

The fan blades 300 include a fan blade body 320 which is secured to a fan blade arm 310. The fan blade arms 310 are secured to a motor body 210 of the motor 200. In the embodiment illustrated, there are three fan blades 300. However, it is to be understood that any number of fan blades 300 could be used in the ceiling fan 10.

A hub body 510 or cannister of the hub assembly 500 is secured to the lower half of the shaft (not shown) of the motor 200, the down rod mounting flange 120, or both. The hub body 510 includes cover mounting protrusions 512 extending inwardly from the hub body 510. The hub cover 520 includes hub cover mounting passages 522 in the sides of the hub cover 520 for engaging the cover mounting protrusions 512 in the hub body 510, thereby securing the hub cover 520 to the hub body 510 in a detachable manner.

The cage 600 includes an upper cage section 610 and a lower cage section 620. The upper cage section 610 is secured to the upper body 400 and depends downwardly therefrom. The lower cage section 620 is secured to the hub body 510 and extends upwardly therefrom. A cage fan blade opening 630 exists between the upper cage section 610 and the lower cage section 620 for the fan blades 300 to extend outwardly through. As illustrated, the upper cage section 610 and the lower cage section 620 are formed of a wire material to maximizing the openness of the cage 600 while maintaining protection of the motor 200. In this manner, the cage 600 protects the motor 200 without placing restrictions on the fan blades or inhibiting the transfer of heat from the motor 200 via radiation and convection.

In one embodiment of the present invention, the ceiling fan 10 includes a lighting kit 700. The lighting kit 700 has a lighting fixture 710 and a light cover 720. The lighting fixture 710 includes a lighting socket 711 which is mounted inside the hub body 510 by a socket bracket 712. Fixture electrical socket leads 713 from the light socket 711 have fixture electrical connectors 714 for connection of the lighting kit. Hub light electrical leads 530 extend through an electrical lead opening 514 in the hub body 510, and have hub light electrical connectors 534 for connection with the fixture electrical connectors 714. A light bulb 715 is disposed in the light socket 711. A light cover 720 is either transparent or translucent is used in place of the hub cover 520 for the lighting kit 700. The electrical leads for supplying the lighting fixture 710 pass through the down rod 110 and the motor shaft (not shown) in a manner that is commonly known to a person of ordinary skill in the art. Light cover mounting passages 722 in the sidewalls of the light cover 720 engage the cover mounting protrusions 512 in the hub body 510 for securing the light cover 720 to the hub body 510 in a detachable manner. By supplying the ceiling fan 10 with the lighting kit 700, a user can decide between a non-lighted fixture and a lighted fixture by deciding on using the hub cover 520, or connecting the socket electrical connectors 714 to the hub light electrical connectors 534 and using the light cover 720 in place of the hub cover 520.

It is thus believed that the operation and construction of the present invention will be apparent from the foregoing description of a preferred embodiment. While the device and method shown are described as being preferred, it will be obvious to a person of ordinary skill in the art that various changes and modifications may be made therein without departing from the spirit and scope of the invention as defined in the following claims. Therefore, the spirit and scope of the appended claims should not be limited to the description of the preferred embodiments contained herein.

What is claimed is:

1. A ceiling fan having a motor connected to a plurality of fan blades, further including a cage surrounding said motor, said cage having a fan blade opening, said fan blades extend outwardly through said fan blade opening, and said fan blade opening providing clearance for said fan blades to rotate without contacting said cage.

2. The ceiling fan according to claim 1, wherein said cage is a wire cage.

3. A method of converting a ceiling fan between an lighted mode and an unlighted mode comprising the steps of:

uncoupling a removable light cover having at least one mounting passage that engages at least one protrusion on the walls of a hub body from a hub body on the fan;

removing a light source from a light socket within said hub body;

coupling a hub cover having at least one mounting passage that engages said at least one protrusion on the walls of the hub body.

4. The method of claim 3 wherein:

said step of uncoupling said light cover does not require removal of screws and requires only manipulation of said light cover by hand; and said step of coupling said hub cover does not require screws and requires only manipulation of said hub cover by hand.

5. The method of claim 3 wherein:

said step of uncoupling said light cover from said hub body is comprised of rotating said light cover to disengage mounting passages located on said light cover from mating engagement with cover mounting protrusions on said hub body.

6. A method of converting a ceiling fan between an unlighted mode and a lighted mode comprising the steps of:

uncoupling a hub cover having at least one mounting passage that engages at least one protrusion on the walls of the hub body from a hub body on the fan;

installing a light source in a light socket within said hub body;

coupling a light cover having at least one mounting passage that engages at least one protrusion on the walls of the hub body onto said hub body.

7. The method of claim 6 wherein:

said step of uncoupling said hub cover requires only manipulation of said hub cover by hand; and said step of coupling said light cover requires only manipulation of said light cover by hand.

8. The method of claim 6 wherein:

said step of uncoupling said hub cover from said hub body is comprised of rotating said hub cover to disengage said at least one mounting passage located on said hub cover from mating engagement with said at least one hub cover protrusions on said hub body.

9. A method of converting a ceiling fan between a lighted mode and an unlighted mode comprising the steps of:

uncoupling a removable light cover having passages for engaging protrusions on the walls of a hub body;

removing a light source from a light socket within said hub body; and coupling a hub cover having passages for engaging said protrusions on the walls of said hub body.

10. The method of claim 9 wherein:

said step of uncoupling said light cover does not require removal of screws and requires only manipulation of said light cover by hand; and said step of coupling said hub cover does not require screws and requires only manipulation of said hub cover by hand.

11. The method of claim 9 wherein:

said step of uncoupling said light cover from said hub body is comprised of rotating said light cover to disengage mounting passages located on said light cover from mating engagement with cover mounting protrusions on said hub body.

12. A method of converting a ceiling fan between an unlighted mode and a lighted mode comprising the steps of:

uncoupling a hub cover having passages for engaging protrusions on the walls of a hub body;

installing a light source in a light socket within said hub body; and coupling a light cover having passages for engaging protrusions on the walls of said hub body.

13. The method of claim 12 wherein:

said step of uncoupling said hub cover requires only manipulation of said hub cover by hand; and said step of coupling said light cover requires only manipulation of said light cover by hand.

14. The method of claim 12 wherein:

said step of uncoupling said hub cover from said hub body is comprised of rotating said hub cover to disengage mounting passages located on said hub cover from mating engagement with cover mounting protrusions on said hub body.

15. A ceiling fan comprising:

a downrod;

a motor supported by said downrod;

a plurality of fan blades rotated by said motor;

a hub body affixed to said downrod below said motor and said plurality of fan blades, said hub body having a downward facing opening;

a light socket for optionally receiving a light source located within said downward facing opening of said hub body; and a removable cover for covering said downward facing opening of said hub body, wherein said cover is selected from a group consisting of a hub cover and a light cover;

a motor body surrounding said motor; and an upper cage at least partially surrounding said motor body.

16. A ceiling fan comprising:

a downrod;

a motor supported by said downrod;

a plurality of fan blades rotated by said motor;

a hub body affixed to said downrod below said motor and said plurality of fan blades, said hub body having a downward facing opening;

a light socket for optionally receiving a light source located within said downward facing opening of said hub body;

a removable cover for covering said downward facing opening of said hub body, wherein said cover is selected from a group consisting of a hub cover and a light cover; and a lower cage affixed to said hub body.

17. A ceiling fan comprising:

a downrod;

a motor supported by said downrod;

a plurality of fan blades rotated by said motor;

a hub body affixed to said downrod below said motor and said plurality of fan blades, said hub body having a downward facing opening;

a light socket for optionally receiving a light source located within said downward facing opening of said hub body;

a removable cover for covering said downward facing opening of said hub body, wherein said cover is selected from a group consisting of a hub cover and a light cover;

an upper cage at least partially surrounding said motor body;

a lower cage affixed to said hub body; and an opening between said upper cage and said lower cage wherein said fan blades extend through said opening.

* * * * *